US006039213A

United States Patent [19]

Sloan et al.

[11] Patent Number: 6,039,213

[45] **Date of Patent: *Mar. 21, 2000**

[54] HAND-HOLDABLE, REUSEABLE CONTAINERS

[76] Inventors: Mark A. Sloan; Jack C. Sloan, both of 2552 E. Alameda, Unit 118, Denver, Colo. 80209

[ * ] Notice: This patent issued on a continued prosecution application filed under 37 CFR 1.53(d), and is subject to the twenty year patent term provisions of 35 U.S.C. 154(a)(2).

[21] Appl. No.: 08/711,323

[22] Filed: Sep. 3, 1996

[51] Int. Cl.[7] ..... B67D 5/32

[52] U.S. Cl. ..... 222/39; 222/78; 222/192; 446/74; 446/81; 446/475

[58] Field of Search ..... 222/78, 39, 192, 222/541.5, 541.7, 81; 235/211, 72; 446/8, 79, 475, 74, 81

[56] References Cited

U.S. PATENT DOCUMENTS

| | | | |
|---|---|---|---|
| 2,689,668 | 9/1954 | Hexel | 222/131 |
| 3,105,612 | 10/1963 | Krasnoff et al. | 222/78 |
| 3,190,510 | 6/1965 | Gonzalez, Jr. | 222/78 |
| 4,073,397 | 2/1978 | Snodgrass | 215/1 |
| 4,749,104 | 6/1988 | Chao | 222/78 |
| 5,199,618 | 4/1993 | Reil et al. | 222/541.5 |

FOREIGN PATENT DOCUMENTS

| | | | |
|---|---|---|---|
| 272699 | 6/1927 | United Kingdom | 222/78 |

*Primary Examiner*—Philippe Derakshani
*Attorney, Agent, or Firm*—Dorr, Carson, Sloan & Birney, P.C.

[57] ABSTRACT

Hand-holdable containers for various, liquid, powder and solid products can be made suitable for a "second use" by providing such containers with an animal simulating configuration, a first opening in the animal's nose region for dispensing an original product stored in the container and a sealed second opening that can be readily unsealed when the original product stored in the container is used up so that said container can be used to store or display other items.

20 Claims, 7 Drawing Sheets

Fig. 1
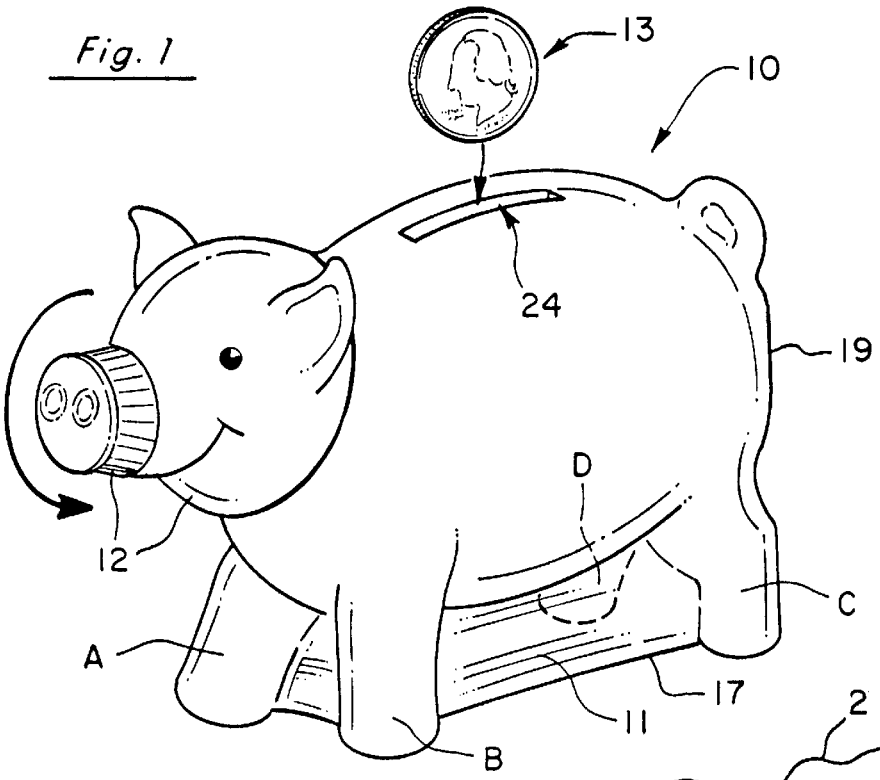
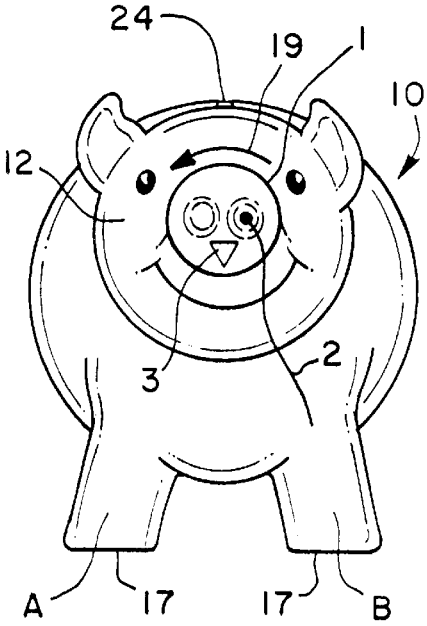
Fig. 2
Fig. 3
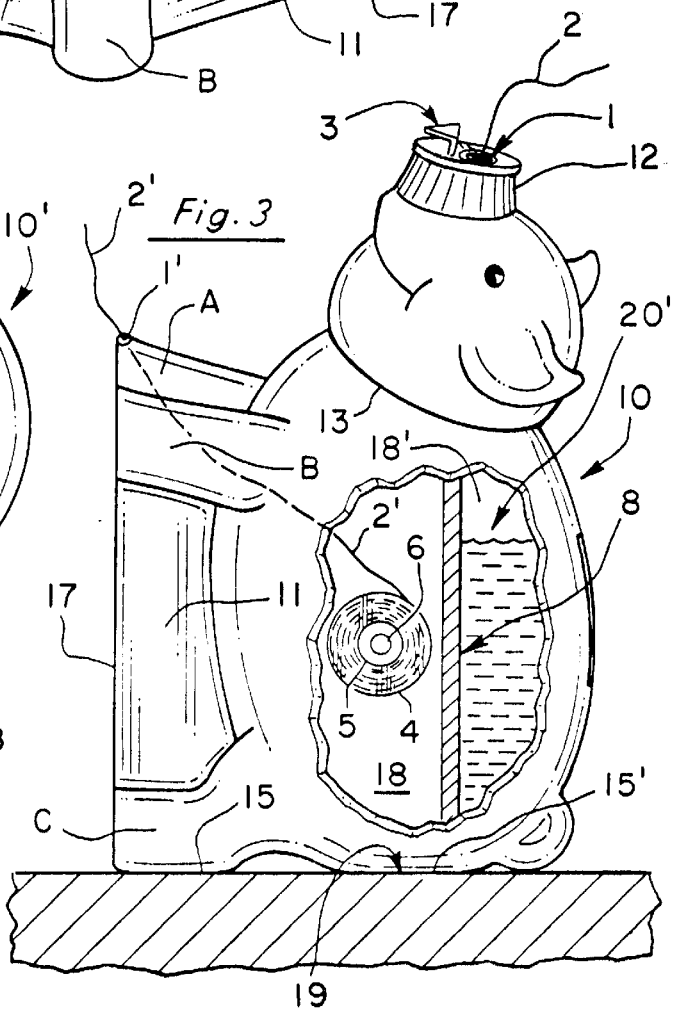

Fig. 8
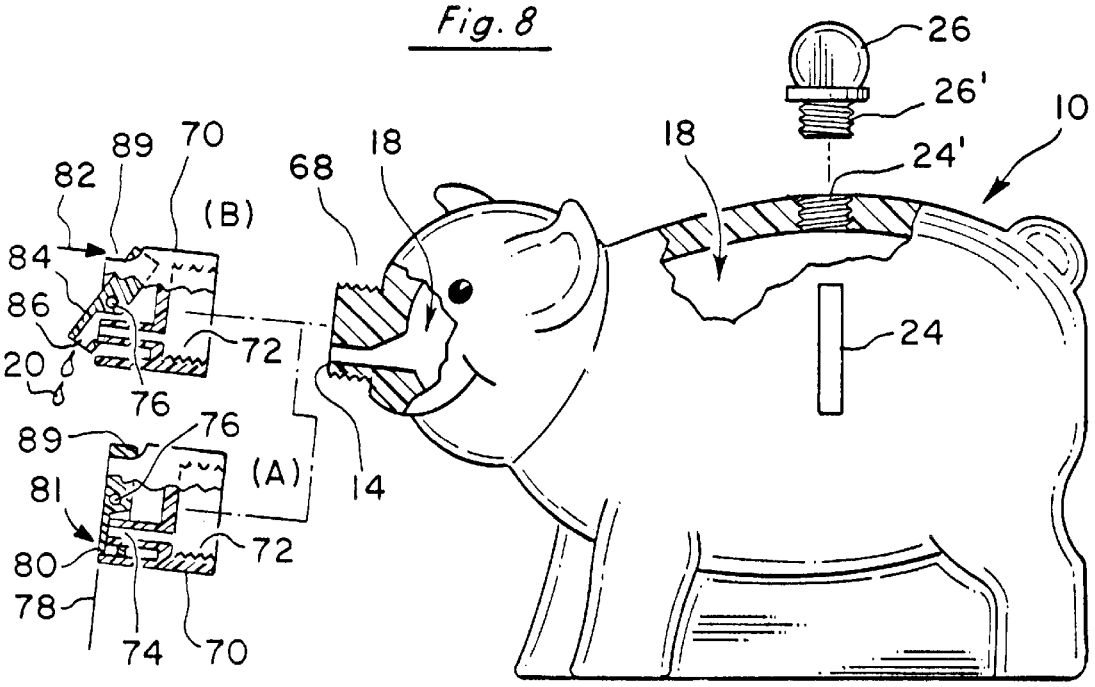
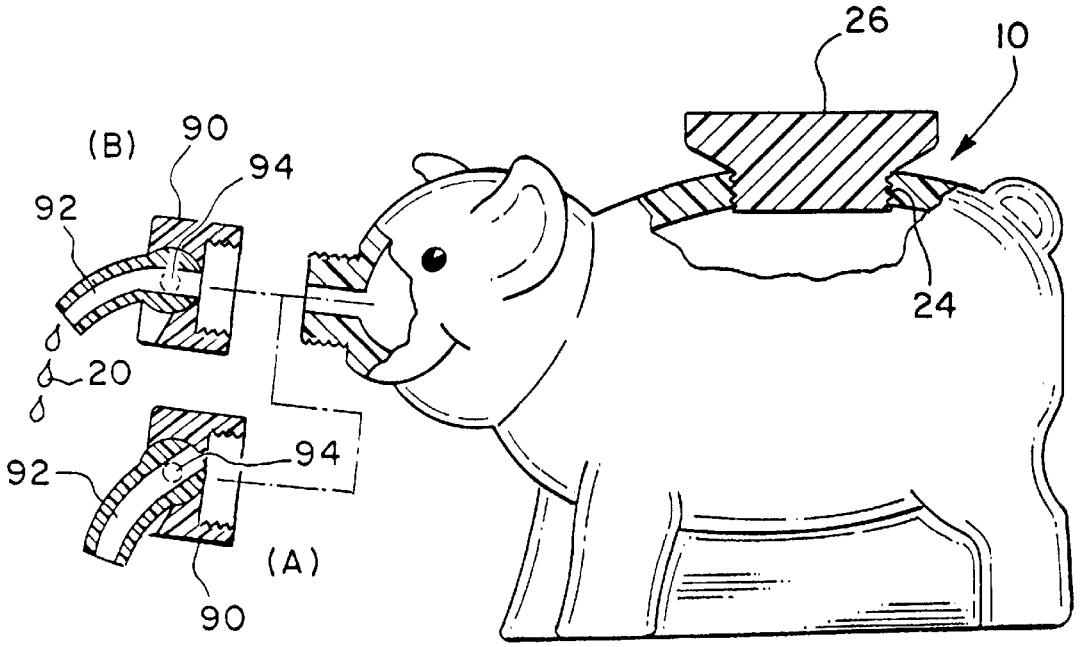
Fig. 9

HAND-HOLDABLE, REUSEABLE CONTAINERS

BACKGROUND OF THE INVENTION

1. Field of the Invention

This invention generally relates to hand-holdable containers for products that normally are dispensed from the container into the user's hand or mouth (e.g., various liquid products such as after-shave lotion, hair tonic, hand lotion, liquid soap, cologne, beverages, mouthwash, etc.; various solid products such as vitamin pills, hard candy, etc.; and various powdered products such as talc, spices, soap powder, etc.). More particularly, this invention is concerned with "novelty" type containers for such products, and especially those novelty containers simulating at least some of the anatomical features of an animal.

2. Statement of the Problem

Most hand-holdable containers are immediately thrown away after the product contained therein has been used up. This probably follows from the fact that most containers of this kind are, at best, made with visually distinctive configurations in order to help identify and "sell" the product contained therein—but such containers seem to have very little or no "secondary" appeal and/or utility. This circumstance has been recognized in some limited cases, but has not been fully addressed by prior art novelty containers, and especially those relatively small novelty containers used to dispense products into their user's hand or mouth.

For example, U.S. Pat. No. 4,073,397 discloses a container generally having the shape of a duck. The liquid contents of the duck-shaped container are dispensed from a threaded spout in the beak or in the neck region of the duck's anatomy. The beak or head serves as the cap of the container. After the contents of the container have been used up, it is especially well suited for use as a duck decoy, or as a child's toy.

U.S. Pat. No. 4,749,104 discloses a cleansing liquid dispenser that is provided with suction cups for mounting said dispenser to a wall. The top of the dispenser has a nose piece that is compression fitted to a rocket-configured body. When the cleansing liquid is used up, the nose piece is removed to expose a slot suitable for passing coins and thereby allowing the rocket body to be used as a "piggy bank."

3. Solution to the Problem

Applicant's invention seeks to extend the useful life of a wide variety of relatively small, hand-holdable containers by providing such containers with: (1) esthetically pleasing, animal-simulating, configurations, (2) at least one additional opening that serves to render such containers suitable for a wide variety of "secondary uses" and (3) devices for readily opening the additional opening(s) when the original product has been used up.

SUMMARY OF THE INVENTION

Hand-holdable containers for products such as after-shave lotion, cologne, shampoo, hair tonic, liquid soap, bubble bath, soap powder, talcum powder, vitamin pills, spices, hard candy, dental floss, beverages, mouthwash and so forth can be given extended useful lives by: (1) providing said containers with a body that simulates at least some of the general configurational and/or anatomical features of an animal such as a dog, cat, pig, cow, goat, lion, horse, bird, fish, whale, insect, etc. so that said containers will be esthetically pleasing as knickknacks, storage containers and/or display holders after the original product contained therein has been used up, (2) providing such containers with a capability to have one or more additional hole(s) suited to some "secondary use", (3) sealing said additional hole(s) while the original product is contained therein and (4) providing means for readily unsealing the additional hole(s) after the original product has been used up.

It should be understood that the containers contemplated in this patent disclosure are intended to "simulate" not only animals that are actually found in nature, but also to simulate: (1) extinct animals (e.g., dinosaurs), (2) mythical animals (e.g., dragons), (3) animals being ridden by humans (e.g., a horse being ridden by a cowboy, etc.) and (4) "fantastic" animals, such as those having the features of two or more different animal species. In short, this invention contemplates a great deal of "artistic license" in depicting the features of the animal being simulated—for a wide variety of artistic, esthetic, fantasy or comic effects.

Next, it should be noted that, for the purposes of this patent disclosure, the term "hand-holdable" container should be taken to mean those containers capable of containing from about 2 to about 32 fluid ounces. It is even more preferable that the containers of this patent disclosure have volume capacities of from about 3 to about 12 fluid ounces. The original product stored in such containers, be that product a liquid, an aerosol material, a powdered solid, or larger solid pieces (e.g., vitamin pills, candy, etc.) may be contained for the most part in a cavity-containing midsection of the hereindescribed animal-simulating containers. This cavity will, to some degree, extend into the neck and/or head region of the animal being simulated and it may also extend into a base region of the container upon which such a simulated animal will normally rest.

The original product is dispensed from applicant's containers via a first opening (or first openings) located in the head region of the animal being simulated. Here, it should be noted that this patent disclosure will usually employ the terms "head" or "head region" even though other terms such as "snout," "beak" "jaw" or "skull" may be somewhat more precise or descriptive. Terminology aside, the head is provided with a cap that serves to close the first opening(s) and thereby contain the product when it is not being dispensed from said container and—to some degree—"simulate", or "exaggerate", some feature of the animal's head such as its nose region. The cap preferably will be mounted on a "vertical", side-facing, region of the container (e.g., the "left side" of the containers depicted in FIGS. 1 to 13) when the animal is depicted as standing on its feet—and therefore in its "normal" horizontal orientation.

In some particularly preferred embodiments of this invention, the cap will have threads adapted for threaded cooperation with threads in the nose region of the simulated animal's anatomy. In other preferred embodiments of this invention, the nose region of the head will be provided with an opening (or openings) having a configuration (e.g., a tapered configuration) suitable for creating a compression fit with a stem (or stems) provided on the "inside" of a cap that is to be associated with the container. In still other preferred embodiments of this invention, the cap is provided with a moveable piece that is connected to a dispensing valve that, in effect, creates a passage through the cap itself, thereby permitting the user to dispense the product without having to actually remove the cap from the container. Indeed, in some particularly preferred embodiments of this invention, such flow-through caps may even be "permanently" mounted to the container by cap locking devices well known to the cap and container manufacturing arts.

Applicant's simulated animal containers also will be provided with one or more second opening(s), or they may be provided with certain thin surfaces suitable for easily creating such second openings by means hereinafter more fully described. In either case, such second openings are made in sizes suitable for passing relatively small items such as coins, pieces of hard candy, powdered materials such as spices, etc., or they may be made suitable for positioning appropriate items such as flower stems, pencils, etc., after the product that was originally stored in the container has been used up and the container is ready to be converted to its "secondary" use.

Such a second opening may, for example, take the form of an upward facing, horizontally extending, slot-like, opening in the "spinal" region of the animal being simulated a la the coin slot in the spinal region of a conventional "piggy bank". Such second opening(s) may have a wide variety of other geometrical shapes, e.g., they may be round or rectangular holes. In some cases, and especially in those cases where the container is made of a relatively soft plastic material, the second "opening" may take the form of a partially completed hole having a core area of decreased thickness that can be readily removed e.g., by being "punched in" or "cut out" with a sharp instrument such as the point of a knife in order to create a "true" hole that is capable of admitting "secondary" items such as coins into the container when it is time to convert said container to its secondary use.

Such second opening(s) also may be located at various other places on the anatomy of the simulated animal e.g., in its neck, ribs, belly, foot, etc. In other embodiments of this invention, there will be multiple second openings suitable for holding a group of similarly shaped items such as pencils or flower stems. These second openings also may be large enough to allow finger accessibility to the inside regions of the container, e.g., a second opening may be large enough to allow human fingers to pick up pieces of hard candy stored in said container. Such second openings also may take the form of a "hinged" trap door-like opening in, say, the simulated animal's belly region. Second openings of this kind are particularly well suited for removing larger, solid, "secondary use" items such as coins from the container.

The hereindescribed animal-configured containers also may, optionally, contain a third opening, and especially a third opening having a configuration different from the second opening. Such third openings may be particularly suitable for receiving nozzles and similar dispensing devices that are frequently used to dispense liquids from automated, bottle-filling equipment. For example, such third openings may be a round hole large enough to receive a nozzle that is used to automatically dispense a liquid, such as after-shave lotion, into such containers. These third openings also may take the form of a small hole through which a string type product such as dental floss, thread or packagetying string may be dispensed.

In some embodiments of this invention, this third opening can be separate and distinct from the second opening. Such "third" opening(s) may, however, also be combined with the second opening(s) in ways hereafter more fully described. In the case of liquid or powdered original products, a slot-like second opening could also be used to load such products into the container; hence, no third opening would be needed. Larger, solid, items such as pieces of hard candy, vitamin pills, etc., would, however, normally require a second or third hole larger than a coin admitting slot. Here again, a trap door-like third opening in the animal's belly region also could be used for such purposes. Larger, solid products (such as pieces of hard candy) also could be loaded into the container as original products via the first opening from which they are dispensed.

The second and/or third opening(s) will normally be filled with appropriately sized and configured plugs while the container is being used to store and dispense the product originally contained therein. By way of example, a threaded plug may be associated with a threaded second (and/or third) opening. By way of a further example, an unthreaded second (and/or third) opening may be filled with a compression-fitting plug. The "compressibility" of such a compression-fitting plug may be achieved by simply making it out of a slightly compressible plastic material such as polyurethane and compression-fitting it into a given second (and/or third) opening after the container has been filled with its original product. Such plugs also may be provided with tabs—and most preferably "finger-grippable" or "plier-grippable" tabs—so that such plugs can be twisted from, or pulled from, the second (and third) opening(s) when the product originally stored in the container has been used up. In those instances in which the second opening is large enough to accommodate human fingers reaching into the container's cavity, such a second opening may be sealed with a plug that is perhaps better described as a "lid." Such lids also may be provided with a tab or handle for use in gripping and positioning the lid back upon the second opening when said container is being used to store certain "secondary" products such as pieces of candy.

As previously noted, these "plug(s)" also may exist in the form of a core-forming, thinner layer of the material from which the container is made—especially when that material is a relatively soft, thermoformable, plastic. Such a layer normally will, however, be thinner than the container wall in the area immediately surrounding this core-forming thinner layer (e.g., the core-forming, thinner layer may be about one half the thickness of the container wall that surrounds said core-forming, thinner layer). Such a core-forming, thinner layer, in effect, will form what might be called a "latent" second opening that can be converted into a "true" second opening (one that allows passage of an object) by removing said thinner layer, e.g., by punching in and/or cutting out the core or thinner layer of material after the original product has been used up. Such thinner layers can be easily removed when the container is made of relatively "soft" plastic materials ("soft" enough to be pierced and cut with a pocket knife) well known to the plastic bottle molding arts. In effect the mold configuration will be used to create the thin layer, or core, in such a "latent" hole.

Thus, in their original product storing and dispensing forms, the containers of this patent disclosure generally will be comprised of a main body region (that may include a base) having a cavity for storing the original product, the original product itself, at least one sealed second opening for containing the original product therein, a head having a head region that, in turn, has at least one first opening for dispensing the product, and a cap that occupies or covers said first opening(s). The first opening(s) is (are) in fluid communication with the cavity in the container where the original product is stored. The first opening(s) also should be appropriately sized to pass the product originally stored therein. For example, if the container is originally used to store and dispense vitamin pills, the container's first opening will be considerably larger than if the container is originally used to store, and "sparingly" dispense, a liquid product such as after-shave lotion. Auxiliary dispensing adapters, hereinafter more fully described, also may be employed to give the hereindescribed containers wider versatilities with respect to their secondary product dispensing capabilities.

The exterior of the midsection of the animal's body may be further provided with labels that serve to impart information, advertisements, warnings, etc., concerning the original product being stored in the container. Finally, the act of twisting off, or otherwise moving or operating some part of the cap (such as the dispensing valve of a flow-through cap), can be used to initiate an electrical signal to cause sound-generating devices associated with the overall container (e.g., sound-emitting devices placed in the body or in the cap of said container) to generate a sound such as, for example, the sound made by the animal being simulated. For example, a pig-shaped container might be programmed, by computer chip devices that are well known to the microelectronic arts, to emit an "oink, oink" sound as the snout (cap) is being removed from a pig-shaped container.

The container body, cap, and plug(s) each can be made from a variety of materials such as various thermoplastic polymers (polystyrene, polyethylene, polypropylene, etc.) glass, ceramic materials, etc. using a wide variety of known manufacturing procedures (e.g., injection molding, blow molding, glass blowing, etc.). If a polymer material is employed, it also should be capable of withstanding chemical attack by the product originally stored therein (e.g., by an alcohol-based, after-shave lotion). It also is contemplated that applicant's containers can be made of a somewhat flexible, hand-squeezable, plastic materials to aid in dispensing a liquid product, such as after-shave lotion, liquid soap or a viscous shampoo from such containers. When compression-fitting plug(s) is (are) employed, it (they) will preferably be made from a thermoplastic polymer (e.g., polyurethane) having a relatively high elastic modulus, that is to say, higher than the elastic modulus of the material from which the container body is made so that the plug will hold a tight compression fit with said container. Such a plug should likewise be capable of withstanding chemical attack by the product originally stored in the container.

BRIEF DESCRIPTION OF THE DRAWINGS

FIG. 1 is a perspective view of a pig-shaped container made according to the teachings of this patent disclosure and having a snout-simulating cap.

FIG. 2 is a frontal view of an alternative pig-shaped container.

FIG. 3 depicts the pig-shaped container shown in FIG. 1 in an "upright" position made possible by virtue of the fact the rear end of the pig-shaped container is provided with a flat, base-forming surface.

FIG. 8 depicts a pig-shaped, container that is shown having a threaded stem for threaded cooperation with a threaded second opening. This container also is provided with a cap having a pivotally mounted valve that can be pivoted outward to expose its dispenser opening and thereby allowing flow of a liquid or powdered product through the cap without having to actually remove said cap from the container.

FIG. 9 depicts another pig-shaped container having a spout-like valve that swings out of the front face of the cap to allow flow of a liquid product through the cap without removing said cap from the container.

DETAILED DESCRIPTION OF THE INVENTION

Figure 4:
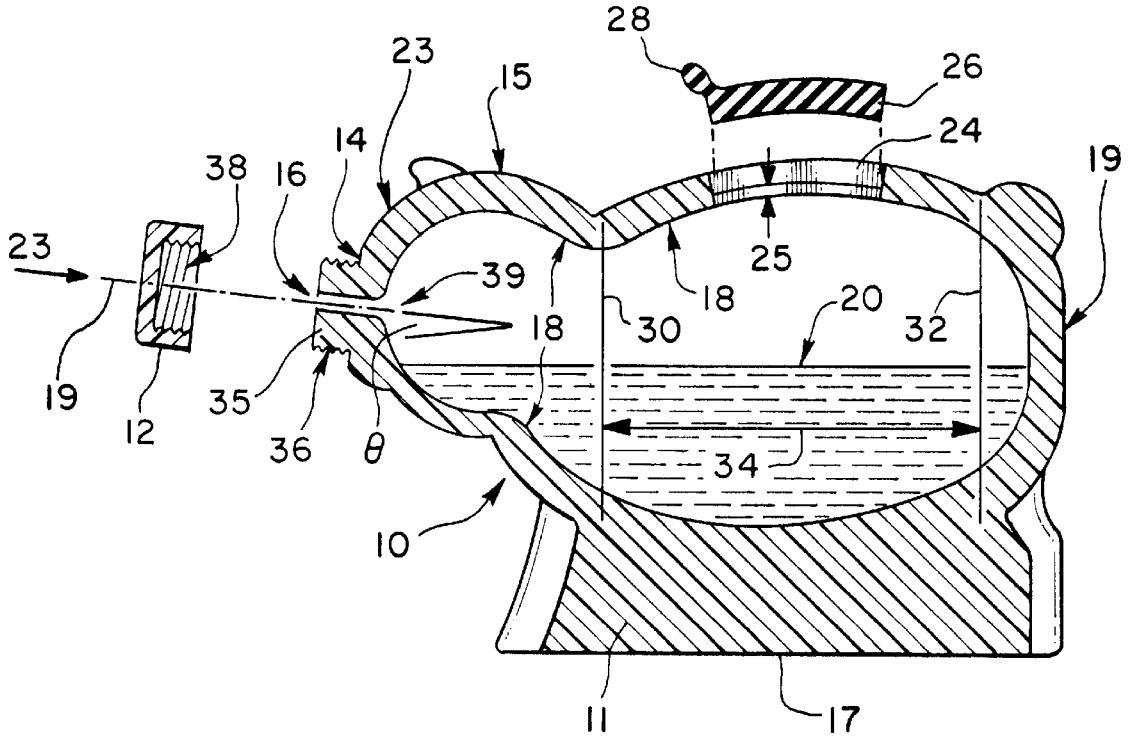
FIG. 4 depicts, in cross-section, a pig-shaped container provided with an externally threaded nose region for receiving an internally threaded cap.

FIG. 1 depicts a hand-holdable container 10 having, for purposes of illustrating an animal-simulating container suitable for practice of this invention, the shape and general anatomical features of a four legged animal, to wit, a pig. Again, it should be appreciated that the shape of any number of other natural animals or animal-simulating "fantasy" figures having at least some of the features or attributes of an animal could serve as a model for the shape of applicant's containers. Thus, such containers could, for example, resemble a dog, cat, cow, goat, tiger, bear, bird, lion, kangaroo, porcupine, horse, sheep, insect, fish, dolphin, alligator, dragon, satyr, etc., in any physical position (e.g., standing, running, sitting, flying, swimming), without departing from the scope and spirit of this patent disclosure. In this regard, the only requirement will be that the animal being simulated have at least some recognizable features that give the container an ability to simulate, to some degree, an animal or fantasy animal. Such animals or fantasy animals also may be depicted as being "ridden" e.g., a cowboy riding a horse.

Be such animal configurations as they may, FIG. 1 specifically shows a cap 12 being used to "simulate" a pig's snout. This container 10 also is depicted in a "secondary use" role wherein a coin 13 is about to be inserted into a slot-like opening 24 in the "spinal" region of the midsection of the pig-simulating container 10. FIG. 1 also is intended to illustrate that, even though the animal-simulating configurations of this patent disclosure may well include separate and distinct legs, in some preferred embodiments, applicant's containers will have a unified base region 11 that comprises a single piece (rather than separate and distinct legs). Such a unified base may, however, be given the general outline and outward appearance of legs A, B, C and D, so as to give the visual impression of being separate and distinct legs. The product-containing cavity (not shown in this "external" view) also may extend well into this base region 11 for added storage capacity.

This base-forming, leg-depicting, effect can likewise be used in the simulation of animals having two legs (e.g., a bird or an ape). An animal such as a whale, having no legs, would simply be mounted on a base that blends into the animal's lower belly region in the manner generally illustrated with respect to the whale shown in FIG. 13. The bottom of the base 11 shown in FIG. 1 most preferably will be provided with one or more flat regions that present a substantially flat surface 17 upon which the container can be set in a stable, generally horizontal orientation in order to present the animal in a "normal", horizontally oriented, standing, lying or flying position.

FIG. 2 is a frontal view of another pig-shaped container 10. It further illustrates how the cap 12 may be made to simulate the snout of a pig. FIG. 2 also illustrates an embodiment of this invention wherein the bottom of the container is in fact provided with separate and distinct legs (e.g., as seen in this view, front legs A and B) rather than being provided with a unified, monolithic, base such as the base 11 depicted in FIG. 1. Such "actual" legs should also form a flat base 17 upon which to set the container in a generally horizontal orientation. FIG. 2 also suggests the preferred, "counterclockwise", direction of turning 19, that serves to remove the cap 12 from the container 10' when the cap is in fact a "removable" cap. Conversely, a "clockwise" turning is preferred to mount such a threaded cap 12 on the containers of this patent disclosure. FIG. 2 also indicates how the nose of the pig can be provided with a hole 1 through which a string product 2 (e.g., dental floss, thread, string, etc.) can be dispensed. A string cutting device 3 such as those used to cut dental floss after being dispensed from a dental floss container is also shown in FIG. 2 in the pig's nose region.

FIG. 3 depicts the container 10 of FIG. 1 sitting in an, "unnatural", legs extended, rear end-sitting, position made possible by the fact that the rear end 19 of the pig-simulating container 10 has been provided with one or more flat regions 15 and 15' that can serve as an alternative base upon which to stand the container in a vertical or "upright" orientation. This is a convenient feature for storing the containers of this patent disclosure in confined places such as upon the shelves of medicine cabinets.

FIG. 3 is shown in partial cut away to illustrate an embodiment of this invention wherein the product being stored in said container 10 is a string-like product 2 such as dental floss, thread, package tying string and the like. Such a string-like product 2 may be dispensed through a first hole 1 in the simulated animal's nose-simulating cap 12. Again, this nose region also may be provided with a string cutting device 3 such as those commonly used to cut dental floss to convenient lengths. Such a string-like product 2 can be wound on a spool 4 having a hole 5 which is mounted on a mounting post 6 so that the spool 4 may rotate on the mounting post 6 and thereby dispense the string product 2 as the string is pulled from a dispensing hole such as hole 1 shown in FIGS. 2 and 3. FIG. 3 also depicts the presence of another dispensing hole 1' that constitutes a small "second opening" or "third opening" (as these terms are used in this patent disclosure), in another part of the pig's anatomy, namely its foot. That is to say that FIG. 3 also shows the string-like product being dispensed via an alternative route 2' that leads to dispensing hole 1' located in one of the pig's front feet. FIG. 3 also illustrates how the internal cavity of these containers may be compartmentalized into two or more separate and distinct compartments 18 and 18' by means of a compartment wall 8. Thus, by way of example, the lower compartment could contain dental floss that is dispensed from the hole 1' in the pig's foot, while the upper compartment could contain after-shave lotion 20' that is dispensed from a hole in the pig's nose region.

FIG. 4 depicts a cut-away side view of an "uncapped" rendition of a hand-holdable container 10 made according to the teachings of this patent disclosure. Its cap 12 is located on a side (the left, or front "face", side) of the animal-shaped container 10 rather than upon a top side of said container (e.g., rather than upon the top of the pig's skull 15 or on its spine) when the pig is regarded as standing in a "natural", horizontal orientation upon its simulated four legs (i.e., upon the flat surface 17 of base 11 as shown, for example, in FIG. 1). The "inner" (that is "uncapped") snout region 14 of the pig is shown provided with external threads 36 for removably attaching an internally threaded cap 12 to said snout region 14 of the pig-shaped container 10. The snout region 14 has at least one first opening 16 that is in fluid communication with a cavity 18 in the container 10. Again, this cavity 18 will generally extend from the body region into the head region of a simulated animal as generally suggested in FIG. 4.

The first opening 16 serves to dispense the original product 20. In use, the original product 20 will normally be dispensed from the first opening(s) 16 by tilting, shaking and/or squeezing the container 10 by hand. The center line 19 of the cap and first hole is shown in FIG. 4 as being tilted at an "upward" angle θ relative to the "horizontal" plane of the base 17 of the container 10. This center line 19 also could be parallel to the horizontal plane of the base, or it could be tilted "downward" with respect to the horizontal plane 17 of the base 11 (in effect this would cause the pig depicted in FIG. 4 to appear as though it were looking downward, toward "the ground"). It is preferred, however, that such a center line 19 for the cap and first opening not be truly vertical—that is say normal to the horizontal plane of the base 17 when the pig is in a natural standing position such as that depicted in FIG. 4. This preference for a non-vertical center line 19 for the cap and first opening implies that the cap and first opening, preferably, are not located in a "top" region of the animal e.g., in the region of the top of its skull (depicted by lead arrow 15) or in its spinal region, since such a positioning would produce some necessity to "invert" the container in order to dispense the product 20. Given the preferred horizontal orientation of the container, the hand/wrist movements needed to accomplish an inversion of the containers of this patent disclosure once they are initially gripped by a user's hand may be somewhat awkward and, for many users, may even require the use of two hands. Thus, it is preferred that the caps for the hereindescribed containers extend from a side of the simulated animal (e.g., the left or face side 23 as depicted in FIG. 4) rather than extend from a top surface of the container in the manner of most prior art, hand-holdable, "upright standing" containers such as beverage bottles, shaving lotion bottles and the like having "vertical" cap/bottle opening center lines. Applicant's cap location should, however, be regarded as a strong preference rather than an absolute prohibition since some configurations (e.g., a wolf with its head thrown back to howl) may place the cap centerline in a vertical or nearly vertical orientation.

Next, it should be noted that the "rear" 19 of the container 10 shown in FIG. 4 is depicted as being capable of forming a stable base upon which the entire container 10 can be set in an "upright", albeit "unnatural appearing", orientation such as that suggested in FIG. 3. Again, this feature greatly aids in storing the hereindescribed containers in "cramped quarters" such as the shelves of medicine cabinets.

The midsection of the pig-shaped container 10 of FIG. 4 is shown provided with a second opening 24 for receiving objects such as coins in the manner of a "piggy bank"—after the product 20 that was originally stored in the container 10 has been used up. This midsection also is the preferred location for a second (and third) opening. When the container 10 is being used as a container for a liquid or powdered original product 20, the second opening 24 will be sealed tightly shut. This can be accomplished in several ways. For example, a plug 26 can occupy the second opening 24; or the second opening can be made with a thin covering or layer 25 over it by virtue of the way the container is originally molded. The plugs may be associated with the container in several ways including a "compression fit" of a plug 26 in a second opening 24 as suggested in FIG. 4. Such plug(s) 26 is (are), most preferably, also provided with at least one finger-grippable, tab 28 provided for pulling a plug 26 from a second opening 24 when the time comes to remove said plug(s) 26 from the container 10.

FIG. 4 also illustrates how in another preferred embodiment of this invention, any given second "opening" 24 may be covered with a relatively thin (relative to the thickness of the container wall surrounding the second opening 24) layer 25 of the material from which the container 10 is made (e.g., a plastic material). This construction feature creates what may be termed a "latent" hole that may be converted into a "true" hole—that is, a hole capable of passing a solid object—by simply "punching in" or "cutting out" this thin layer 25 with an appropriate hand tool such as the point of a knife when the time comes to convert the container to a secondary use. FIG. 4 also shows a highly preferred embodiment of this "latent hole" feature wherein the thickness of this thin layer 25 is considerably less than (e.g., less than half of) the thickness of the container wall in the area immediately surrounding the latent hole. Thus, for the purposes of this patent disclosure these latent holes, along with the thin layer of material that covers them, should be regarded as falling with the term(s) "second opening" or "third opening".

Figure 5:
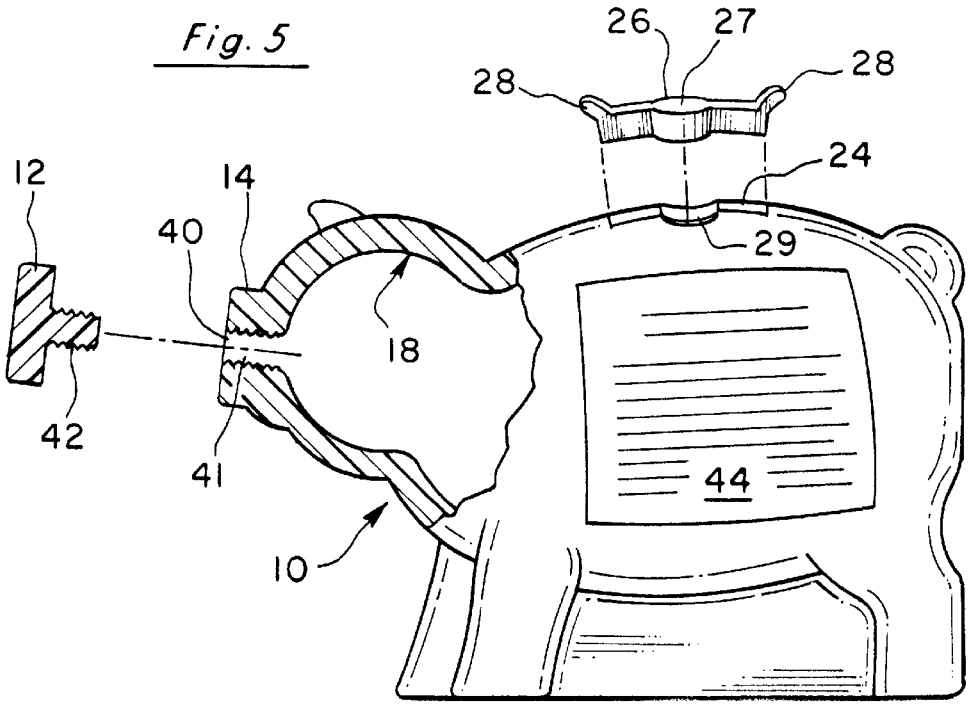
FIG. 5 depicts, in partial cut-away, a pig-shaped container that is provided with an internally threaded first opening in its nose region that is capable of receiving an externally threaded stem mounted on a cap to be associated with this container.
Figure 6:
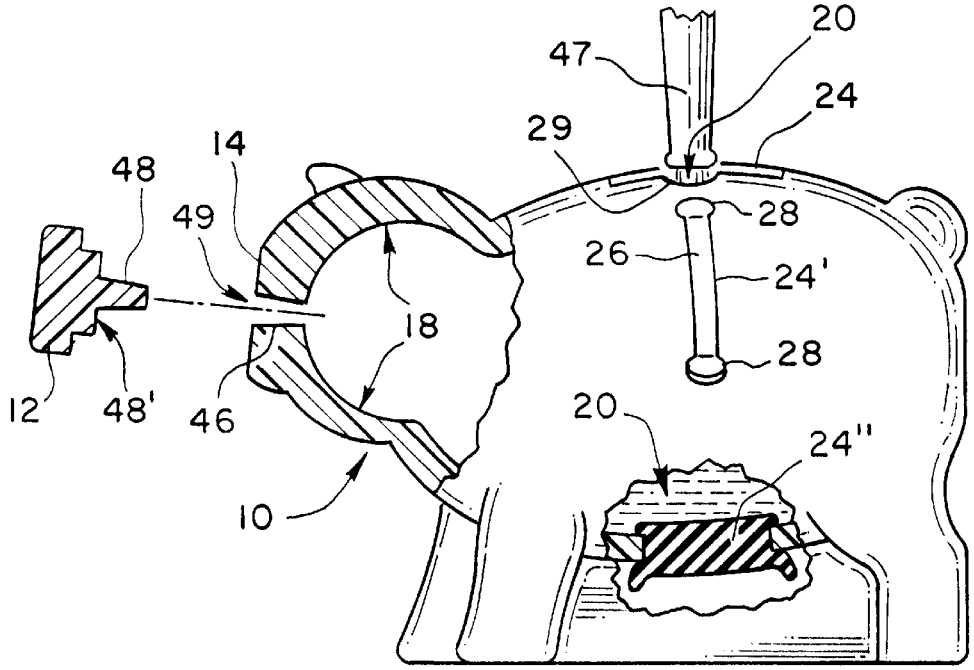
FIG. 6 depicts a pig-shaped container that is provided with a tapered first opening in the pig's nose that is adapted to form a compression fit with a similarly tapered stem on the inside of a cap to be associated with this container.

In yet another preferred embodiment of this invention, the second opening 24 will include a third, hole-like, opening 29, such as those respectively depicted in FIGS. 5 and 6. Such third openings will preferably have a geometry different from that of the second opening 24. In such cases where the second and third holes are so combined, the third opening will have a diameter greater than the thickness of a coin so that the third opening can be conveniently used to fill the container 10 with solid products such as pills. Preferably, the second (and, if need be, third) opening(s) will be in the "spinal region" of the midsection of these containers. This midsection generally will be located in the mid-torso region of the simulated animal's body, e.g., between lines 30 and 32 on the simulated pig shown in FIG. 4, i.e., in the area generally indicated by the span of item lead line 34. This second opening also may be located in the head or neck region—especially when a four-legged animal is depicted in a sitting position.

Again, the means for attaching the cap 12 to the snout, nose, beak, jaw, etc., of the simulated animal's anatomy may vary in ways well known to the container and cap manufacturing arts. For example, FIG. 4 illustrates a pig-shaped container 10 having a post 35 that has been provided with an external thread system 36 for receiving an internally threaded hole 38 of a cap 12 to be associated with the pig-shaped container shown in FIG. 4. This cap 12 is shown in cross section—and detached from post 35—in order to better illustrate a thread system that is especially well suited to the practice of this invention. FIG. 4 also illustrates how the cavity 18 may extend to include the entire inside of the pig's head as well as its midsection 34.

FIG. 5 depicts a pig's nose region 14 that has been provided with a first opening 40 that leads to cavity 18 which, in this case, also constitutes a part of the pig's head. The first opening 40 is shown provided with internal threads 41 for threaded cooperation with an externally threaded stem 42 on a cap 12 to be associated with the pig-shaped container 10. A plug 26 having an enlarged circular center region 27 for occupying a suitably configured hole 29 having a diameter greater than the width of slot-like second opening 24 is shown located near the center of the slot-like second opening 24. This plug 26 also is shown provided with two finger-grippable tabs 28 to facilitate removal of said plug 26 from the second opening 24. This container 10 also is shown provided with a label 44 that can be used to give information about the product, make advertisements, make warnings and so forth.

Figure 5A:
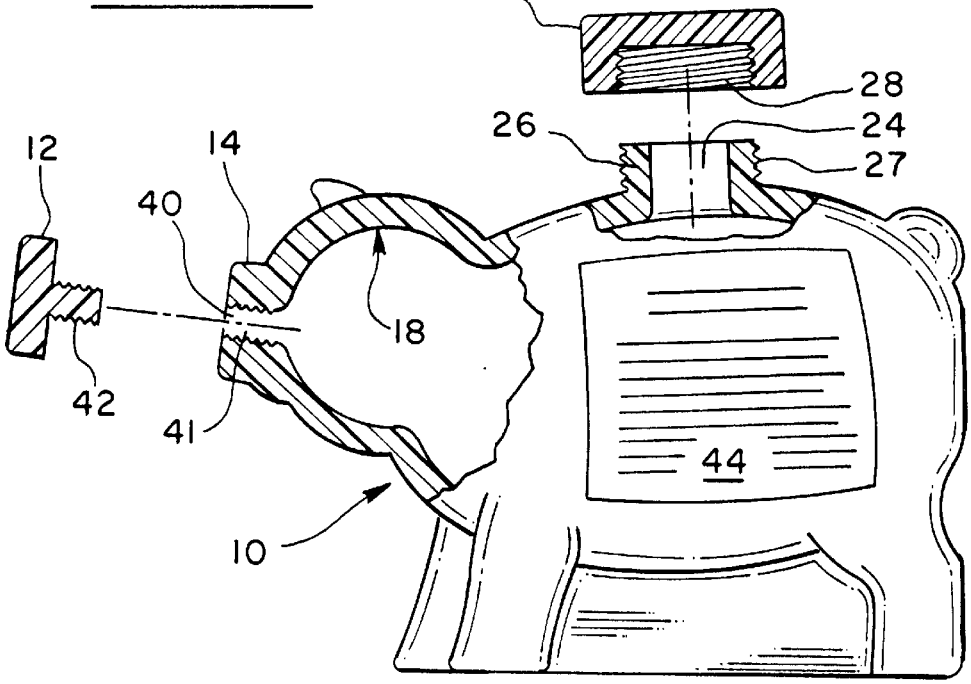
FIG. 5A depicts, in partial cross-section, a pig-shaped container provided with a second opening in the form of a raised, externally threaded neck, for receiving an internally threaded cap.

FIG. 5A depicts a pig-shaped container provided with a second opening 24 that is comprised of a raised neck region 26 having external threads 27. A cap 29' having internal threads 28 for threaded cooperation with the external threads 27 of the second opening 24 is shown positioned above said second opening.

Figure 5B:
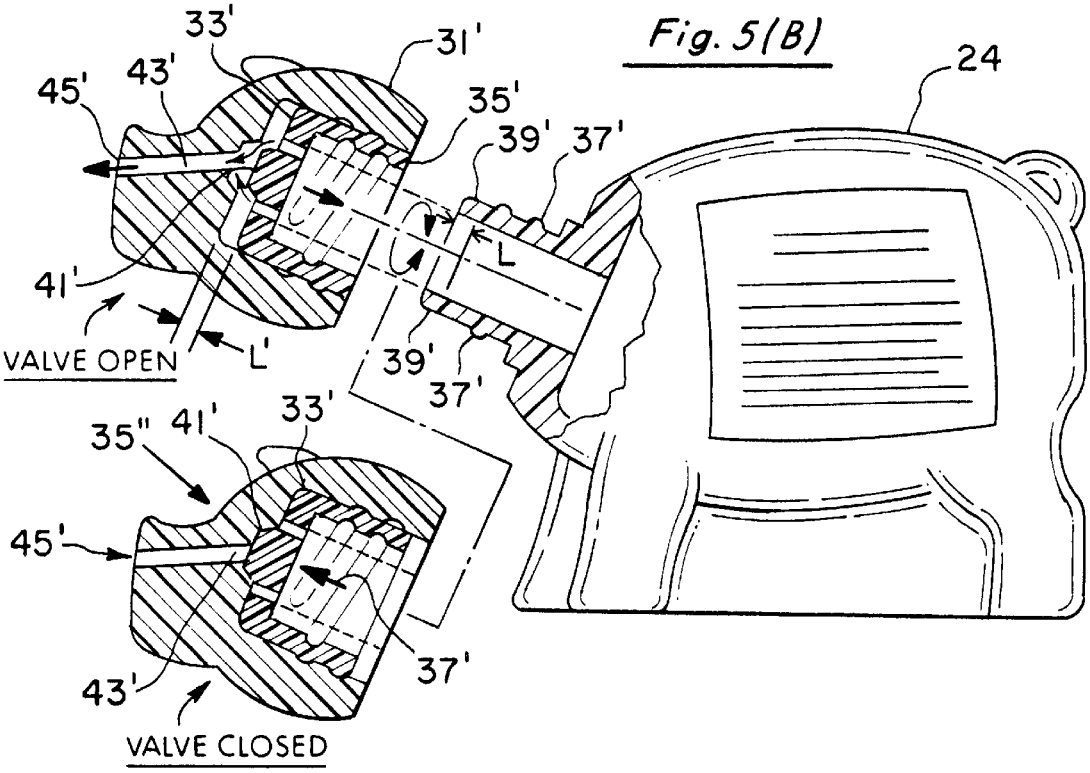
FIG. 5B depicts, in partial cross-section, a pig-shaped container whose head is provided with a flow through valve that is operated by threads on the simulated pig's neck such that the head (cap) need not be removed in order to dispense a liquid or powdered product from the container.

FIG. 5B depicts a pig-shaped container provided with a head 31' that contains a flow through valve 33' that is provided with an internally threaded sleeve 35' that is operated by the threads 37' on the exterior of the neck of the animal. The threads 37' on the exterior of the neck lead to an unthreaded or slide collar region 39'. The presence of this unthreaded collar region allows the head to be moved up and down over the distance defined by the length L of the unthreaded collar and thereby moving the flow through valve 33' up or down by this same distance as shown by the travel distance distance L' of valve 33' in the head 31' of FIG. 5(*b*). When the head 31' is forced downward a tip 41' on the end of the flow through valve 33' is forced upward into a passageway 43' in the head of the animal being simulated. This action of pushing downward (see arrow 35") and thereby forcing flow through valve 33' in an upward direction (see arrow 37') is depicted by the "valve closed" version of the pig's head shown in FIG. 5(B). In effect, this action closes the passageway 43' and prevents a liquid product from being dispensed from hole 45' at the end of passageway 43'. Conversely, when the head is pulled in an upward direction, (designated by the "valve open" depiction of the pig's head in FIG. 5(B)) the tip 41' is pulled out of the end of passageway 43' and a liquid product can flow around the flow through valve 33' and be dispensed through hole 45'.

FIG. 6 illustrates a pig-shaped container 10 having a somewhat conically-shaped hole 46 in its nose region 14 for receiving a conically shaped post 48 of cap 12 in a "compression type fit" that does not involve a thread system. The conical nature of these two elements has been exaggerated somewhat in FIG. 6 in order to better illustrate these conical configurations. In another preferred embodiment of this invention, the post 48 will be further provided with a stop rim 48' that serves—when the cap 12 is mounted to the container 10—to prevent the rear of the cap 12 from completely abutting against the front surface 49 of the nose region 14. This in turn serves to position a portion of the cap slightly away from the front surface 49 of the nose region 14. This arrangement facilitates finger gripping the cap 12 in order to pull it out of hole 46. The second opening 24 in FIG. 6 is shown with a third hole 29 suited to receiving flow from a dispensing nozzle 47 such as those commonly used in automated bottle-filling equipment. The container 10 is shown in FIG. 6 with a second slot-like additional opening 24' that is filled with a plug 26 having tabs 28 for removing said plug 26. A third opening having a geometry different from that of the second opening is shown in the pig's belly region being occupied by a plug 24".

Figure 7:
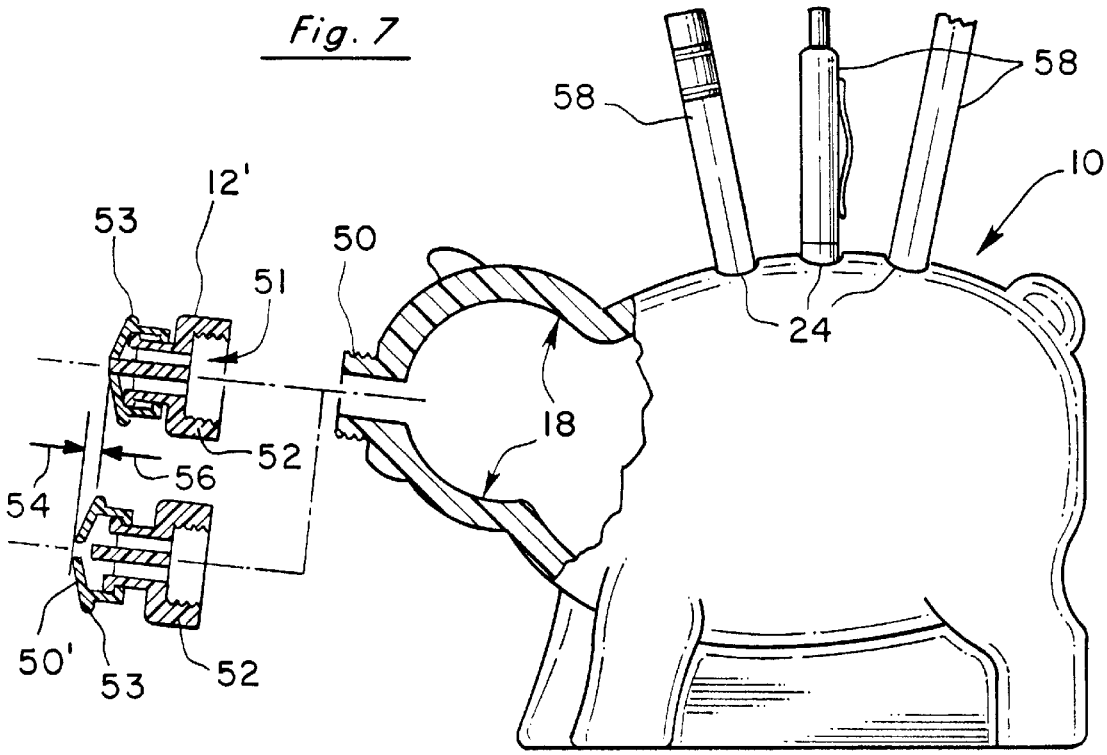
FIG. 7 depicts a pig-shaped container that is provided with a cap having a nose piece that can be pulled forward to allow flow of product through the cap without having to remove said cap from the container. The body region of the container is shown provided with several "second" openings that are each occupied by a pencil or pen.

FIG. 7 illustrates a pig-shaped container 10 whose nose region has been provided with an externally threaded post 50 for threaded cooperation with a threaded hole 51 of a "flow-through" type cap 12'. This flow-through cap 12' can be threaded on to post 50—but it does not have to be removed from post 50 in order to dispense product 20 from the container 10. Indeed, the flow-through caps that may be employed on the containers of this patent disclosure may be "permanently" attached to such containers by cap locking devices well known to the cap and bottle manufacturing arts. Thus, the various "flow-through" valves described in this patent disclosure can be threaded on to, and then locked on to, such containers. These flow-through caps need not even be provided with threads if they are to be "permanently" mounted to the container. For example, such flow-through caps may be mounted to the nose region of a simulated animal by other well known mechanical devices, e.g., by so-called "bayonet locking devices" that usually are applied by forcing a nub on one component into alignment with a receiving groove having a nub-receiving and locking indentation on another component and then rotating one component with respect to the other until the nub enters the nub-receiving indentation. Regardless of the mode by which they are attached to the container, however, such caps are best employed when the original product 20 is a liquid or a freely flowing powder.

Those skilled in this art will appreciate that, in addition to the flow-through valve system shown in FIG. 5(B), there are several other different valving systems for flow through caps that may be employed in the practice of this invention. For example, FIG. 7 illustrates another flow-through system provided by a cap having a dispensing valve 52 that is pulled to a "forward" position 54 in order to open a dispensing hole 55 of valve 52, and thereby allowing a fluid product such as after-shave lotion or liquid soap to flow through the cap 12' while said cap remains mounted on the container 10. Flow-through caps 12' having product dispensing valves of this kind can be further provided with a ridge 53 that can be gripped by the user's finger tips in order to pull a dispensing nozzle 50' of valve 52 to a forward position 54. When the dispensing nozzle 50' is forced back toward the container to a rearward position 56, the dispensing hole 55 of valve 52 is closed; hence, product 20 will no longer be able to pass through the cap 12'. Finally, FIG. 7 illustrates a secondary embodiment of this invention wherein several second openings 24 are each shown holding a respective pencil or pen 58 for secondary "display" and utility purposes.

FIG. 8 depicts a container 10 having a plug 26 provided with threads 26' for threaded cooperation with a threaded second opening 24'. Another second opening 24 in the form of a vertically oriented coin slot is shown in the rib region of the pig-shaped container 10. The snout of this pig-shaped container is shown provided with threads 68 in order to attach and detach a threaded cap 70 to the container 10. That is to say that threads 68 cooperate with the internal threads 72 of cap. This particular cap 70 illustrates another type of flow-through valve mechanism. For purposes of such illustration, it is depicted in two distinct operating details A and B. In detail A, a valve 74 in the face of the cap is shown mounted on a pivot 76. This valve 74 is depicted in its closed position wherein it is flush with the plane 78 of the face of the cap 70. It is moved to this closed position by pushing in on its lower edge 80 as suggested by the directional arrow 81 shown in Figure A. Detail B shows flow-through valve 74 in its open position. This position is accomplished by pushing inward at the upper edge 82 of the pivotally-mounted flow-through valve 74 and thereby causing said valve's lower region 84 to project outward. This outward projection in turn exposes the valve's fluid dispensing hole 86 so that product 20 may be dispensed from said hole 86. An indentation 89 in the face of cap 70 can be provided to facilitate finger tip pushing of flow-through valve 74 to the open, product-dispensing, position shown in detail B.

FIG. 9 depicts a pig-shaped container 10 having a cap 90 that has yet another kind of flow-through valve 92. It is mounted on a pivot 94 so that it can be pulled from the closed position depicted in detail A to the open position depicted in detail B in order to dispense product from the container. FIG. 9 also shows the container provided with a plug 26 having yet another configuration.

Figure 10:
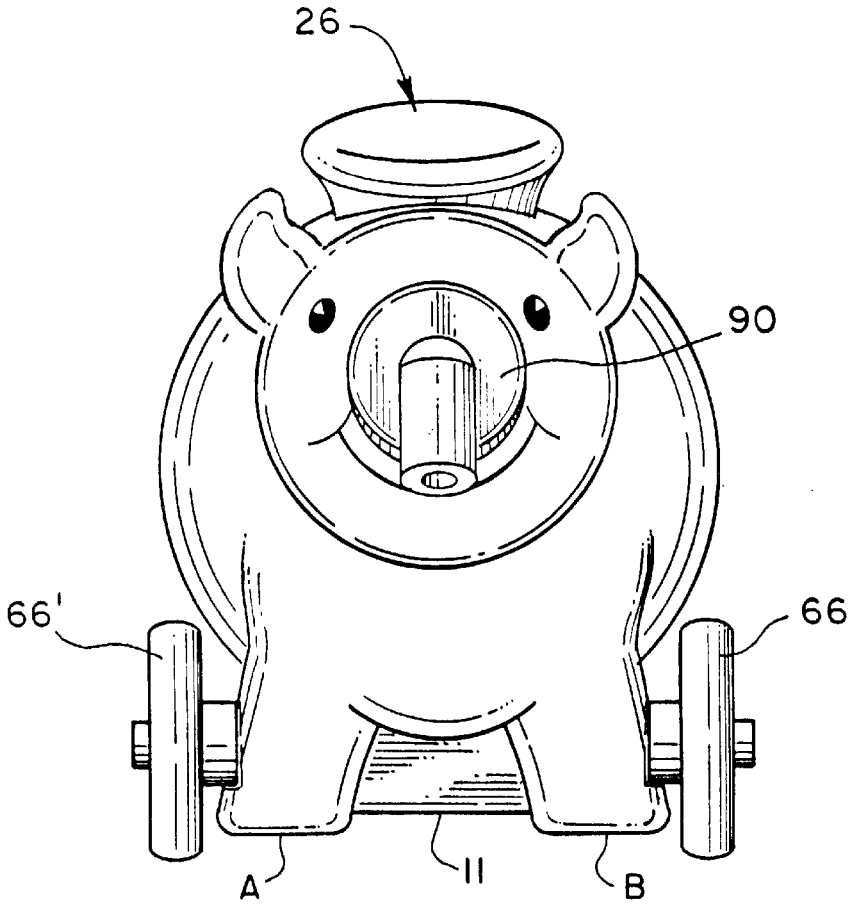
FIG. 10 depicts the front view of the container of FIG. 9.

FIG. 10 depicts the pig-shaped container 10 of FIG. 9 in a front view that better illustrates that the base 11 extends between the pig's legs A and B.

Figure 11:
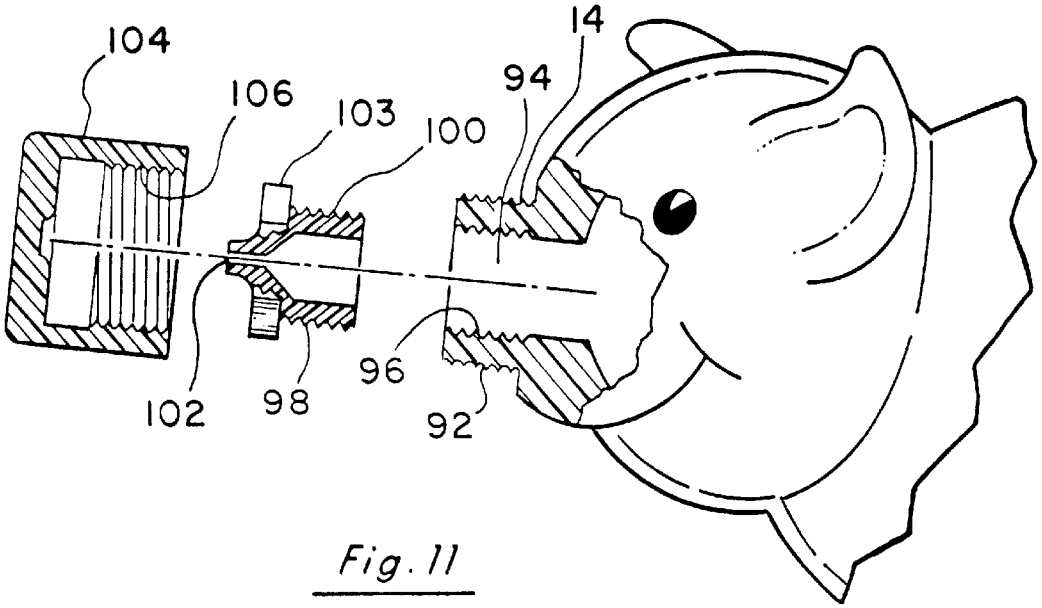
FIG. 11 depicts the use of an auxiliary adapter that facilitates dispensing a liquid-type original product and, when removed, also facilitates removing solid secondary items, such as stored coins, from the container.

FIG. 11 depicts the head region of a pig-shaped container 10 having external threads 92 in its nose region 14. The nose region is also shown provided with a relatively large hole 94 (relative to small hole 102 of the dispensing adapter 98) that is provided with internal threads 96. This large hole 94 can be fitted with a dispensing adapter 98 having external threads 100 for threaded cooperation with internal threads 96 of the relatively large hole 94 of container 10. The adapter 98 also could be provided with a tapered smooth bore tube (rather than threads 100) and simply compression fitted into a large hole 94 that, likewise, would have no threads. Be that as it may, the adapter 98 shown in FIG. 4 is shown provided with a small hole 102 adapted to "sparingly" dispense a liquid product such as after-shave lotion. It also may be provided with a raised surface 103 (e.g., a hexagonal nut) for gripping and twisting the adapter 98 to remove it from hole 94. Thus, after a liquid product has been used up, such an adapter 98 can be removed from large hole 94 so that relatively large solid items, such as coins, can be thereafter readily removed from said container—via the hole 94 left open when the adapter 98 is removed from the container. The adapter 98, as well as threads 92 on nose 14, also can be covered by a cap 104 having internal threads 106 that cooperate with, and cover, external threads 92 on the pig's nose region.

Figure 12:
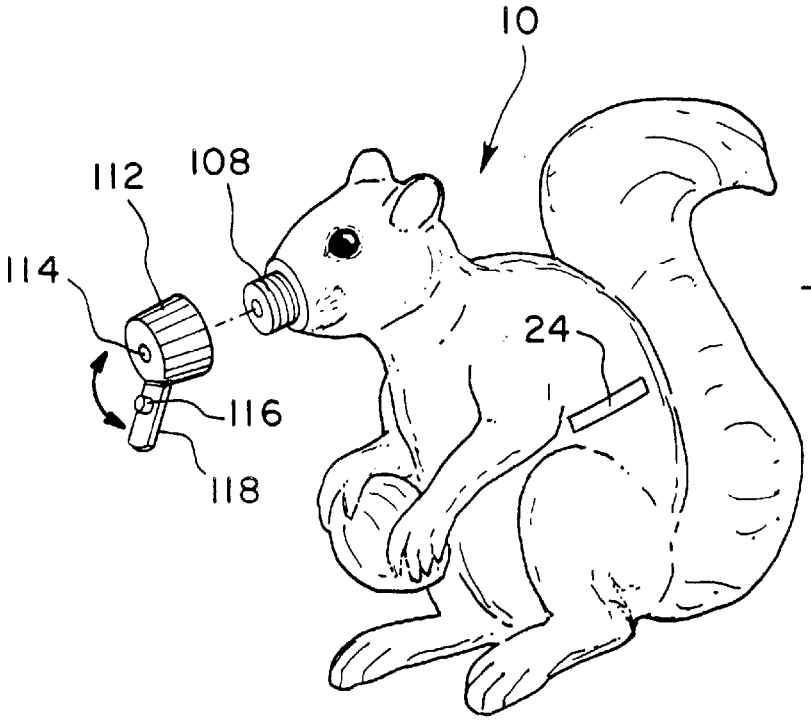
FIG. 12 depicts a container having the general appearance of a sitting squirrel and having an externally threaded nose for receiving a threaded cap that is provided with a hinged front snout piece that serves as a liquid product dispensing valve.

FIG. 12 depicts a squirrel-shaped container 10 wherein the squirrel is in a sitting position. The squirrel's nose region is provided with a threaded post 108 for threaded cooperation with an internally threaded hole of a nose-like cap 112. The nose-like cap 112 is shown provided with a flow-through hole 114 that is filled with a stopper nub valve 116 mounted on a hinged front face tab 118 of said cap 112.

Figure 13:
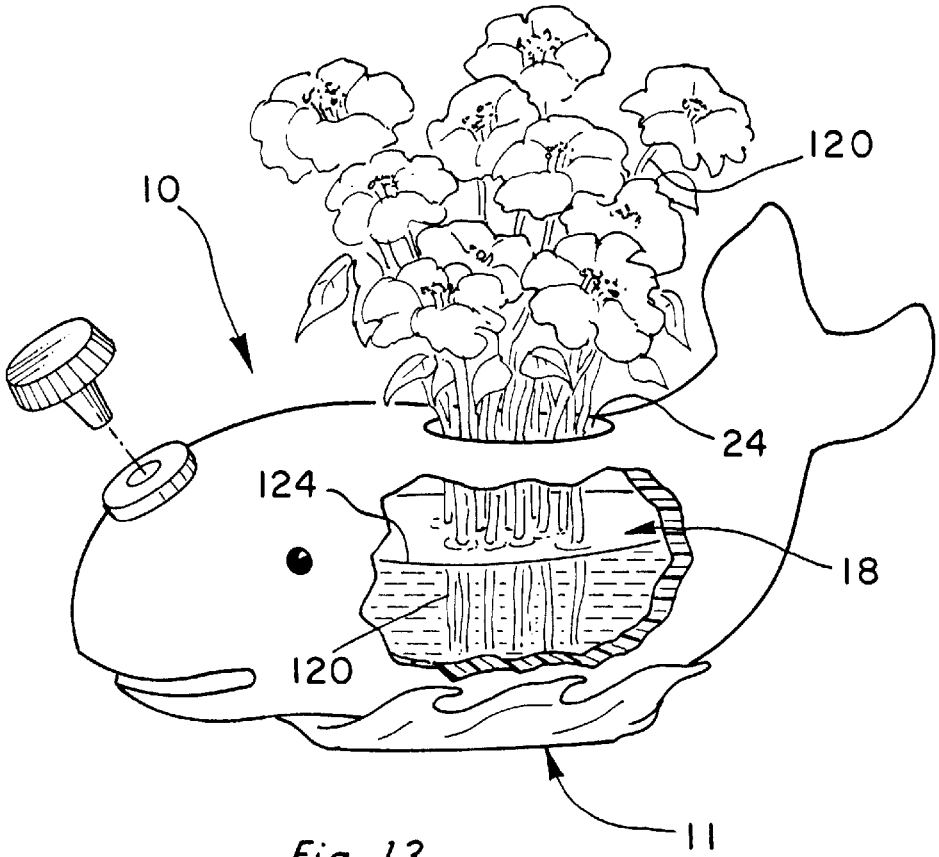
FIG. 13 depicts a whale-shaped container having a base that blends into the belly region of said whale. The whale-shaped container is shown provided with a second opening that is holding flower stems that extend in to the inner cavity of this container so that said container can carry out the function of a flower vase.

FIG. 13 depicts a whale-shaped container 10 whose belly region blends into its flat base 11. The second opening 24 of this container is shown holding flower stems 120. The cavity 18 is shown provided with water 124 into which the stems 120 extend so that the container 10 can serve as a flower vase.

It should be appreciated that only a few of the many possible animal, or fantasy animal, configurations that might be employed in the practice of this invention have been illustrated in this patent disclosure. Consequently, the scope of this invention should be limited only by the scope of the patent claims that follow.

I claim:

1. A hand-holdable after-shave lotion container comprising a body that simulates the anatomical features of a pig and wherein a head of said pig has a first opening in its nose region for dispensing after-shave lotion from the container and wherein said nose region has threads for removably attaching a threaded, flow through, nose-simulating cap to the nose region and wherein a spine region of said pig is further provided with a slot-like second opening that is sealed with a compression fitting plug having a gripping tab such that the slot-like opening is sealed while the container is used to dispense the after-shave lotion contained therein and thereafter permanently unsealed by pulling on said finger-grippable tab and thereby removing said plug from said slot-like opening such that said opening can pass coins into a torso region of said pig.

2. The container of claim 1 that further comprises a cap having internal threads capable of being threadedly attached to, and detached from, external threads on said head.

3. The container of claim 1 that further comprises a cap having an externally threaded stem capable of being threadedly attached to, and detached from, an internally threaded first opening in said head.

4. The container of claim 1 wherein the threads for attaching the cap to said head constitute a thread system that is so constructed that turning the cap in a counterclockwise direction with respect to a front view of said animal's nose region will remove the cap from the container.

5. The container of claim 1 that further comprises a flow-through cap having a valve for dispensing after-shave lotion through the cap without having to remove said cap from the container, said valve being opened by pulling a nozzle away from a front face region of the cap to a forward position to create a passageway through which the after-shave lotion can flow from the container and through the cap.

6. The container of claim 1 that further comprises a flow-through cap having a valve for dispensing after-shave through the cap without having to remove said cap from the container, said valve being opened by pushing on an edge of a valve that is pivotally mounted in a front face of the cap so as to pivot the front face valve outward and thereby expose a hole through which the after-shave lotion can be dispensed from the container and through the cap.

7. The container of claim 1 that further comprises a flow-through cap having a valve for dispensing product through the cap without having to remove said cap from the container, said valve being opened by pulling a nub valve that is mounted on a hinged tab and thereby removing the nub valve from a hole in the front face of the cap so that the after-shave lotion can be dispensed from the container and through the cap.

8. The container of claim 1 that further comprises a second opening located in said animal's midsection.

9. The container of claim 1 that further comprises a plug that is compression-fitted in the second opening.

10. The container of claim 1 that further comprises a threaded plug that occupies a threaded second opening.

11. The container of claim 1 that further comprises a plug in the form of a layer of material over a second opening and wherein said layer of material has a thickness that is less than the thickness of the container in the region around the second opening so that said layer of material may be readily removed in order to create a true second opening.

12. The container of claim 1 wherein the second opening is in the form of a slot capable of passing a coin.

13. The container of claim 1 wherein the second opening is in the form of a slot having an expanded open region for introduction of the product into the container.

14. The container of claim 1 wherein said container is provided with a third opening have a configuration different from the second opening.

15. The container of claim 1 wherein said container is provided with a dispensing adapter.

16. The container of claim 1 that further comprises a stable base-forming rear end suitable for setting the container in an upright position.

17. The container of claim 1 wherein said container further comprises a post for mounting a spool.

18. The container of claim 1 wherein said container is made of a plastic material.

19. The container of claim 1 wherein said container is made of a flexible plastic material capable of being squeezed by pressure supplied by a user's hand.

20. The container of claim 1 that further comprises a cap having a sound-emitting device.

* * * * *